US009879420B2

(12) United States Patent
Joseph et al.

(10) Patent No.: US 9,879,420 B2
(45) **Date of Patent: *Jan. 30, 2018**

(54) PARTITION WALL SYSTEM WITH CLAMPING PROFILE

(71) Applicant: Maars Holding B.V., Harderwijk (NL)

(72) Inventors: Johannes Joseph, Harderwijk (NL); Quoc Xuong Luu, Harderwijk (NL); Pieter Marcel De Graaf, Harderwijk (NL)

(73) Assignee: MAARS HOLDING B.V., Harderwijk (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/769,307

(22) PCT Filed: Feb. 27, 2014

(86) PCT No.: PCT/NL2014/050119

§ 371 (c)(1),
(2) Date: Aug. 20, 2015

(87) PCT Pub. No.: WO2014/133387

PCT Pub. Date: Sep. 4, 2014

(65) Prior Publication Data

US 2015/0376899 A1 Dec. 31, 2015

(30) Foreign Application Priority Data

Feb. 27, 2013 (NL) ..... 2010367
Mar. 6, 2013 (NL) ..... 2010400

(51) Int. Cl.
*E04H 1/00* (2006.01)
*E04H 3/00* (2006.01)
(Continued)

(52) U.S. Cl.
CPC ..... *E04B 2/7401* (2013.01); *E04B 2/828* (2013.01); *E06B 3/5821* (2013.01);
(Continued)

(58) Field of Classification Search
CPC ..... E04B 2/7401; E04B 2/828; E04B 2002/7496; E04B 2/82; E04B 2/281; E04B 2/825; E04B 3/5821
(Continued)

(56) References Cited

U.S. PATENT DOCUMENTS 2,027,870 A * 1/1936 Larson ..... E04B 2/78 52/220.7
2,054,189 A * 9/1936 Bemis ..... E04B 2/58 52/287.1
(Continued)

FOREIGN PATENT DOCUMENTS

DE 29620643 3/1998
DE 202004007841 1/2005
(Continued)

*Primary Examiner* — Joshua J Michener
*Assistant Examiner* — Keith Minter
(74) *Attorney, Agent, or Firm* — Marcus C. Dawes; Daniel L. Dawes

(57) ABSTRACT

A wall comprising an upper horizontal member to be fixed to a ceiling, a lower horizontal member to be fixed to a floor, and at least one panel provided between the upper horizontal member and the lower horizontal member, characterized in that the lower horizontal member comprises at least two longitudinally extending, elongate profiles of U-shaped cross-section, wherein the first profile is fixed to the floor with a base part of its U-shaped cross-section, wherein the second profile is placed on the first profile, wherein base parts of the U-shaped cross-sections of the two profiles face away from each other, wherein the lower horizontal member further comprises a third profile of U-shaped cross-section
(Continued)

provided between the first profile and the second profile thereof.

20 Claims, 10 Drawing Sheets

(51) Int. Cl.
*E04B 2/74* (2006.01)
*E04B 2/82* (2006.01)
*E06B 3/58* (2006.01)
*E06B 3/66* (2006.01)
*E06B 3/54* (2006.01)

(52) U.S. Cl.
CPC ..... *E06B 3/6621* (2013.01); *E04B 2/825* (2013.01); *E04B 2002/7462* (2013.01); *E04B 2002/7496* (2013.01); *E06B 3/5427* (2013.01)

(58) Field of Classification Search
USPC ..... 52/241
See application file for complete search history.

(56) References Cited

U.S. PATENT DOCUMENTS 2,772,554 A * 12/1956 Schacht ..... E05C 9/026 292/139
2,968,374 A * 1/1961 Bohnsack ..... E04B 2/825 52/241
3,081,849 A * 3/1963 Eugene ..... E04B 2/96 49/413
3,282,007 A * 11/1966 Campbell ..... E04B 2/7818 52/205
3,423,897 A * 1/1969 Birum, Jr. ..... E06B 1/12 49/504
3,830,027 A * 8/1974 Paisley ..... E04B 2/825 52/211
3,852,926 A * 12/1974 Papsco ..... E04B 2/825 52/241
3,885,361 A * 5/1975 De Schutter ..... E04B 2/78 52/126.4
3,991,519 A * 11/1976 Bakke ..... E06B 7/231 49/159
4,574,547 A * 3/1986 Menchetti ..... E06B 1/36 52/238.1
4,621,470 A * 11/1986 Balinski ..... E04B 2/825 52/241
4,905,428 A 3/1990 Sykes
5,644,877 A * 7/1997 Wood ..... E04B 2/7407 52/126.3
6,202,382 B1 * 3/2001 Conterno ..... E04C 2/543 52/235
8,584,317 B2 * 11/2013 Liebscher ..... E04B 2/827 16/91
9,057,201 B2 * 6/2015 Milligan ..... E04F 21/1877
2009/0241445 A1 * 10/2009 Sprague ..... E04B 2/827 52/243.1
2010/0251644 A1 * 10/2010 Quesada ..... E06B 1/003 52/215

FOREIGN PATENT DOCUMENTS

FR 2491524 4/1982
FR 2800405 5/2001
GB 2322663 9/1998

* cited by examiner

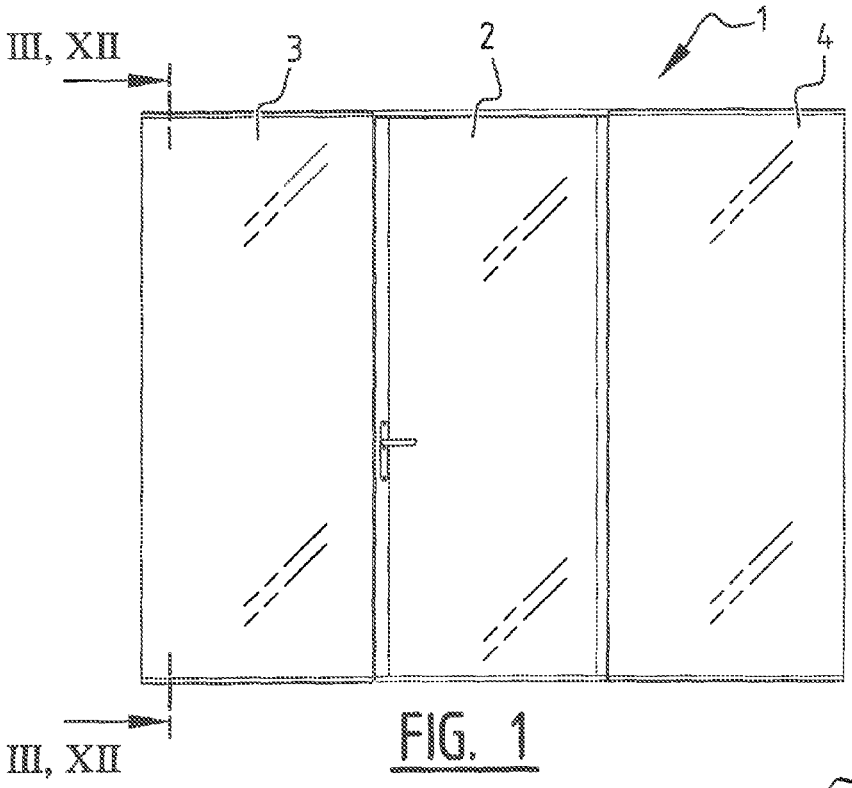
FIG. 1
FIG. 2A
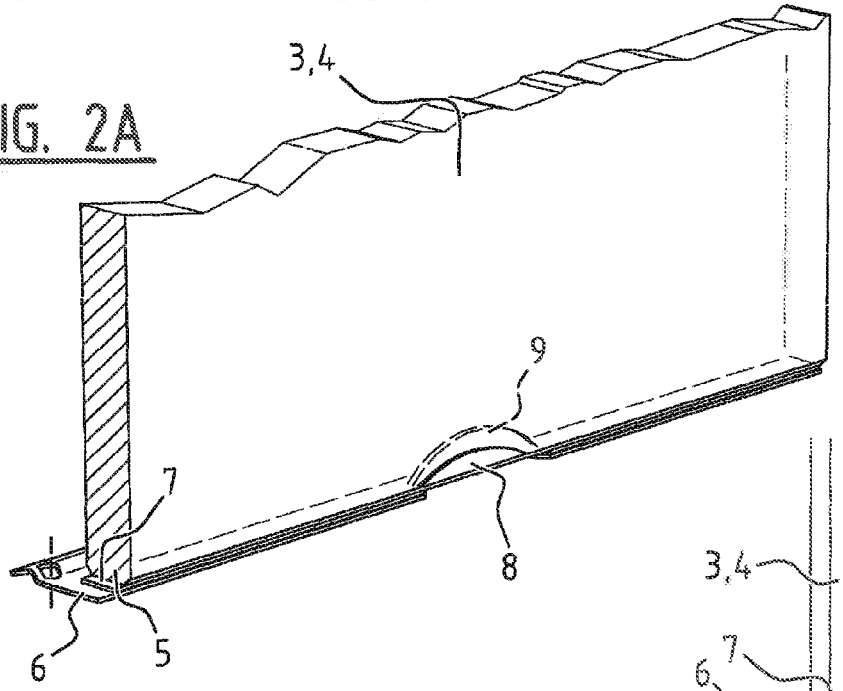
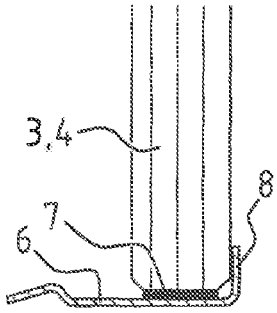
FIG. 2B

PARTITION WALL SYSTEM WITH CLAMPING PROFILE

The present invention relates to a wall, which wall comprises an upper horizontal member to be fixed to a ceiling, a lower horizontal member to be fixed to a floor, and at least one panel provided between the upper horizontal member and the lower horizontal member. The invention in particular relates to such a wall which is or can be prefabricated from standard components.

It is noted that within the framework of the invention the wall is in particular a partition wall designed for partitioning off a space in a building that is accessible to persons. It is further noted that the panel according to the invention is preferably a glass panel or a panel of plastic material (for example Perspex). In other preferred variants, the panel is a wooden or steel panel.

Such a wall configured as a partition wall is generally known. The known partition walls, also called "system walls", are used in various kinds of interior construction, for example in office buildings, airports, hospitals, industrial estate, public institutions, schools, hotels, cinemas and retail establishments. The glass panels in such partition walls are generally made up of two spaced panes, for example of hardened glass. Usually, such glass panels are heavy, however, so that mounting and removing the glass panel in the known partition wall (for example in the case of a broken pane) is a laborious and time-consuming job, in particular in the case of a floor and/or a ceiling that is not level. In addition, the glass panel in the known partition wall needs to be firmly anchored therein for safety reasons. However, the consequent use of all kinds of additional components is at odds with the preference for modular partition walls built up of standard components as regards dimensions and choice of materials.

The object of the invention is to improve the prior art, i.e. to provide an aesthetic partition wall, wherein the panel configured as a wall module can be mounted in a simple manner also between a floor that is not (entirely) level and a ceiling that is not (entirely) level. Another object of the invention is to make it possible to mount the panel in the wall in a simple manner, in spite of its dimensions and weight, anchor it and remove it therefrom again, if desired, without harming the modular structure of standard components of the partition wall.

In order to achieve that object, a wall of the kind described in the introduction is according to the invention characterised in that the lower horizontal member comprises at least three longitudinally extending, elongate profiles of U-shaped cross-section, wherein the first profile is fixed to the floor with a base part of its U-shaped cross-section, wherein the second profile is placed on the first profile, wherein base parts of the U-shaped cross-sections of the two profiles face away from each other, wherein the lower horizontal member further comprises a third profile of U-shaped cross-section provided between the first profile and the second profile thereof. As a result, unevennesses in the floor (i.e. in the case of a non-level floor) can be compensated in a simple manner, whilst the height of the lower horizontal member can be configured to be as small as possible. After all, the invention makes it possible to adjust the vertical positions of the first, the second and the third profile relative to each other in dependence on the floor, and subsequently fix the profiles in a desired position.

In a preferred embodiment of a wall according to the invention, the upper horizontal member comprises at least three longitudinally extending, elongate profiles of U-shaped cross-section, wherein the first profile is fixed to the ceiling with a base part of its U-shaped cross-section, wherein the second profile is placed on the first profile, wherein base parts of the U-shaped cross-sections of the two profiles face away from each other, wherein the upper horizontal member further comprises a third profile of U-shaped cross-section provided between the first profile and the second profile thereof. As a result, unevennesses in the ceiling (i.e. in the case of a non-level ceiling) can be compensated in a simple manner, whilst the height of the upper horizontal member can be configured to be as small as possible. The legs of the U-shaped cross-section of the first, the second and the third profile of the upper horizontal member in particular comprise mating ribs which function to prevent the second profile and the third profile from falling down during mounting.

In another preferred embodiment of a wall according to the invention, base parts of the U-shaped cross-sections of the first and the third profile face away from each other. In particular, legs of the U-shaped cross-section of the third profile embrace legs of the U-shaped cross-section of the first profile, whilst legs of the U-shaped cross-section of the second profile embrace legs of the U-shaped cross-section of the third profile. The first, the second and the third profile are thus preferably telescopic, making it possible to compensate for unevennesses in the floor and/or the ceiling by telescoping the profiles in or out relative to each other. The relative vertical positions of the first, the second and the third profile can thus be adjusted and be fixed by means of spacer means between the profiles, such as spacer blocks.

In another preferred embodiment of a wall according to the invention, base parts of the U-shaped cross-sections of the first and the third profile face each other. Preferably, legs of the U-shaped cross-section of the first profile embrace legs of the U-shaped cross-section of the third profile, whilst legs of the U-shaped cross-section of the third profile in particular embrace legs of the U-shaped cross-section of the second profile. In this preferred variant, too, the first, the second and the third profile are preferably telescopic, making it possible to compensate for unevennesses in the floor and/or the ceiling by telescoping the profiles in or out relative to each other. The relative vertical positions of the first, the second and the third profile can thus be adjusted and be fixed by means of spacer means between the profiles, such as spacer blocks, in this variant as well.

In another preferred embodiment of a wall according to the invention, the spacing between the base parts of the U-shaped cross-sections of the second and the third profile is adjustable. More in particular, instead thereof or in addition thereto, the spacing between the base parts of the U-shaped cross-sections of the first and the third profile is adjustable.

In another preferred embodiment of a wall according to the invention, the base part of the U-shaped cross-section of the second profile comprises a springy clamping profile mounted thereon, wherein the panel comprises a lip fixed to the bottom edge thereof, which lip extends inward and which is clampingly provided between the base part of the U-shaped cross-section of the second profile and the springy clamping profile so as to connect the panel to the lower horizontal member and/or the upper horizontal member. This makes it possible in a simple manner to mount the panel in the wall (by moving the panel (in a vertical position thereof) in horizontal direction, as a result of which the lip is received in a slot of the clamping profile), anchor it therein and remove it again therefrom, if desired. The panel is preferably a glass panel, with the lip fixed to its bottom edge extending inward, i.e. toward the wall. Preferably, at least two panels are mounted on either side of the upper horizontal member and the lower horizontal member, which panels are clampingly provided between the upper horizontal member and the lower horizontal member. The use of a clamping profile makes it possible to give the wall any desired length, so that varying dimensions can be readily realised while using one (standard) clamping profile.

In another preferred embodiment of a wall according to the invention, the lip fixed to the bottom edge of the panel and the lip fixed to the upper edge of the panel extend along the entire width of the panel.

In another preferred embodiment of a wall according to the invention, the lip fixed to the bottom edge of the panel and the lip fixed to the upper edge of the panel are each provided with a profiled, longitudinal insert edge. The insert edges preferably comprise an upwardly sloping insert surface.

In another preferred embodiment of a wall according to the invention, the lip fixed to the bottom edge of the panel and the lip fixed to the upper edge of the panel are glued to the panel at their longitudinal edges remote from the insert edges.

In another preferred embodiment of a wall according to the invention, longitudinal edges remote from the insert edges of the lip fixed to the bottom edge of the panel and of the lip fixed to the upper edge of the panel are flanged along at least part of their length, wherein flanged parts thereof extend into recesses in the panel. As a result, the lip is firmly anchored to the panel. In another preferred variant, said longitudinal edges remote from the insert edges are flanged along the entire length of the lips, wherein the longitudinal edges abut against the vertical side surface of the panel.

In another preferred embodiment of a wall according to the invention, the clamping profiles of the second profiles of the lower horizontal member and the upper horizontal member each have a W-shaped cross-section. The clamping profiles preferably extend along the entire length of said second profiles. In another preferred variant, the clamping profile has a T-shaped cross-section.

In another preferred embodiment of a wall according to the invention, legs of the W-shaped cross-section are spring legs, wherein longitudinal edges of the legs are bent inwards. This makes it possible to achieve that mounting a panel will be easier than removing the same. The wall can thus be built up in a simple and quick manner, whilst the panel is nevertheless firmly attached.

In another preferred embodiment of a wall according to the invention, the wall is provided with a door between a lower horizontal member and an upper horizontal member thereof, wherein the lower horizontal member and the upper horizontal member each comprise at least three longitudinally extending, elongate profiles of U-shaped cross-section, wherein the first profile is fixed to the floor with a base part of its U-shaped cross-section, wherein the second profile is placed on the first profile, wherein base parts of the U-shaped cross-sections of the two profiles face away from each other, wherein the lower horizontal member further comprises a third profile of U-shaped cross-section provided between the first profile and the second profile thereof, and wherein base parts of the U-shaped cross-sections of the first and the third profile face away from each other.

In another preferred embodiment of a wall according to the invention, the lower horizontal member and the upper horizontal member of the door have the same height as the corresponding horizontal members of the rest of the partition wall.

The invention also relates to a U-shaped cross profile for a wall according to the invention, which U-shaped cross profile comprises a base part, which base part comprises, on a first side thereof, profile wall sections that extend transversely to the base part, and which is provided, on a second side thereof, with a W-shaped or T-shaped clamping profile, which is connected to the base part with a central part thereof and which defines two legs extending from the central part, wherein the legs are configured as spring legs, with two slots being defined between the legs and the second side of the base part, and wherein the legs are provided with locking projections on the side of the legs that faces the second side of the base part.

Such a U-shaped cross profile is quite suitable for building up a partition wall according to the invention. The locking projections extend in the longitudinal direction of the clamping profile and may for example be made up of folded-over longitudinal edges of the legs of the clamping profile. The locking projections are preferably configured so that inserting a lip of a panel will be easier than removing the same (snap locking projections). Advantageous embodiments of the clamping profile will be discussed in the description of the figures.

The invention will be explained in more detail below with reference to figures illustrated in a drawing, in which:

FIG. 1 is a front view of a partition wall in a preferred variant according to the invention, whilst FIG. 2*a* is a perspective partial view of a glass panel used therein and FIG. 2*b* is a partial side view;

Figure 11:
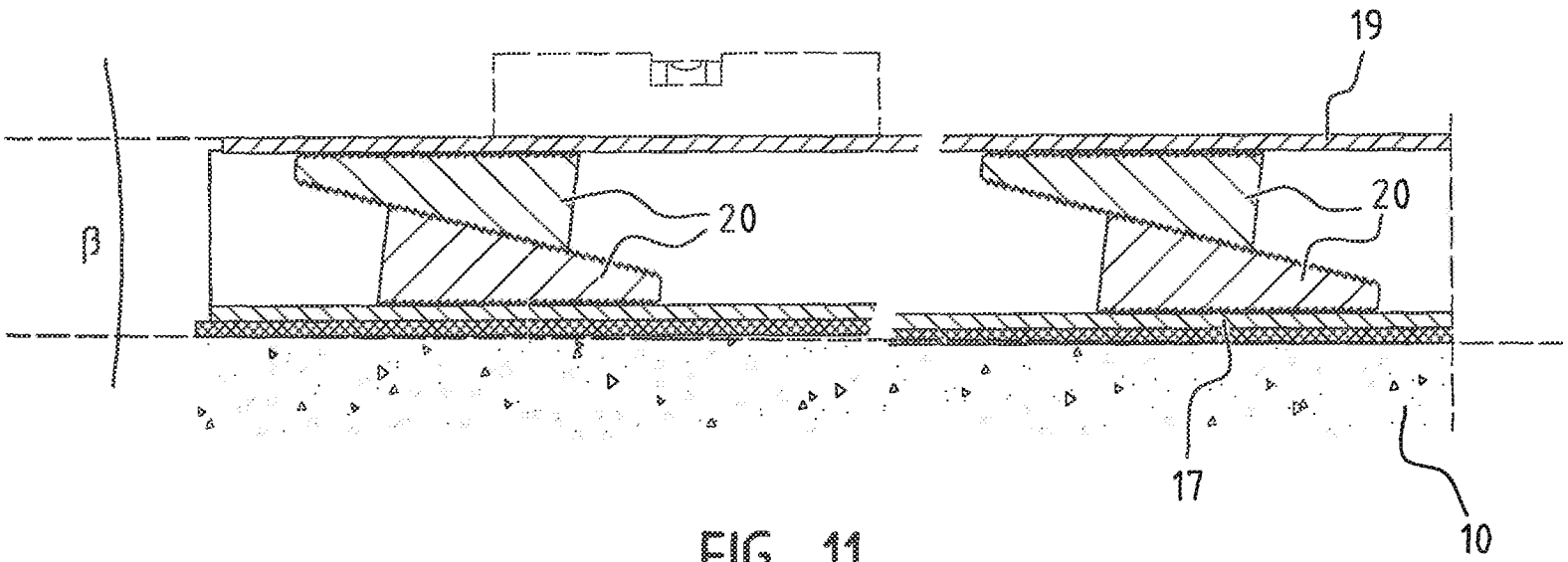
Figure 19B:
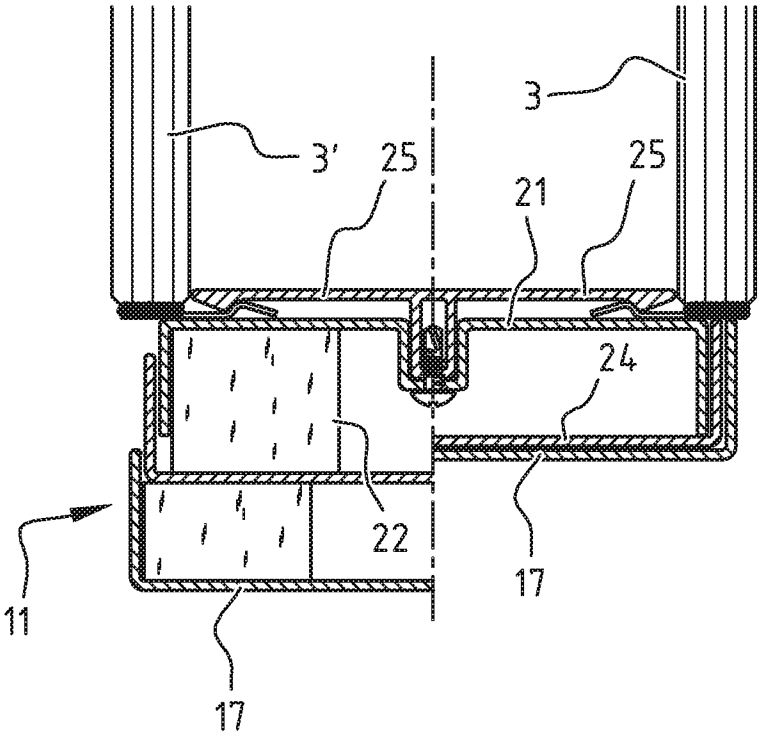
Figure 19A:
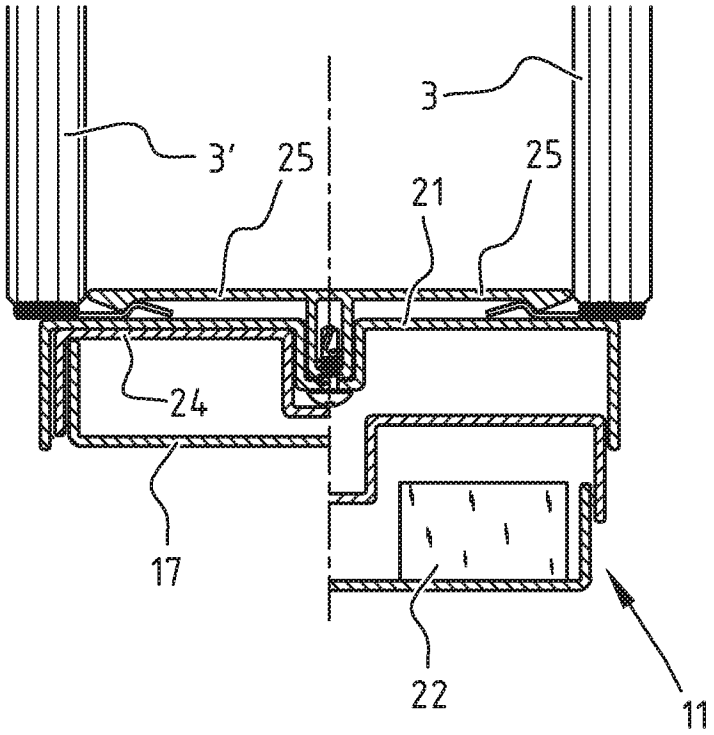

FIGS. 13-18 correspond to FIGS. 4-9, albeit relating to an assembly of the partition wall of FIG. 11 in which components which are in part different are used; and FIG. 19 is a cross-sectional view showing two embodiment variants.

Figure 3:
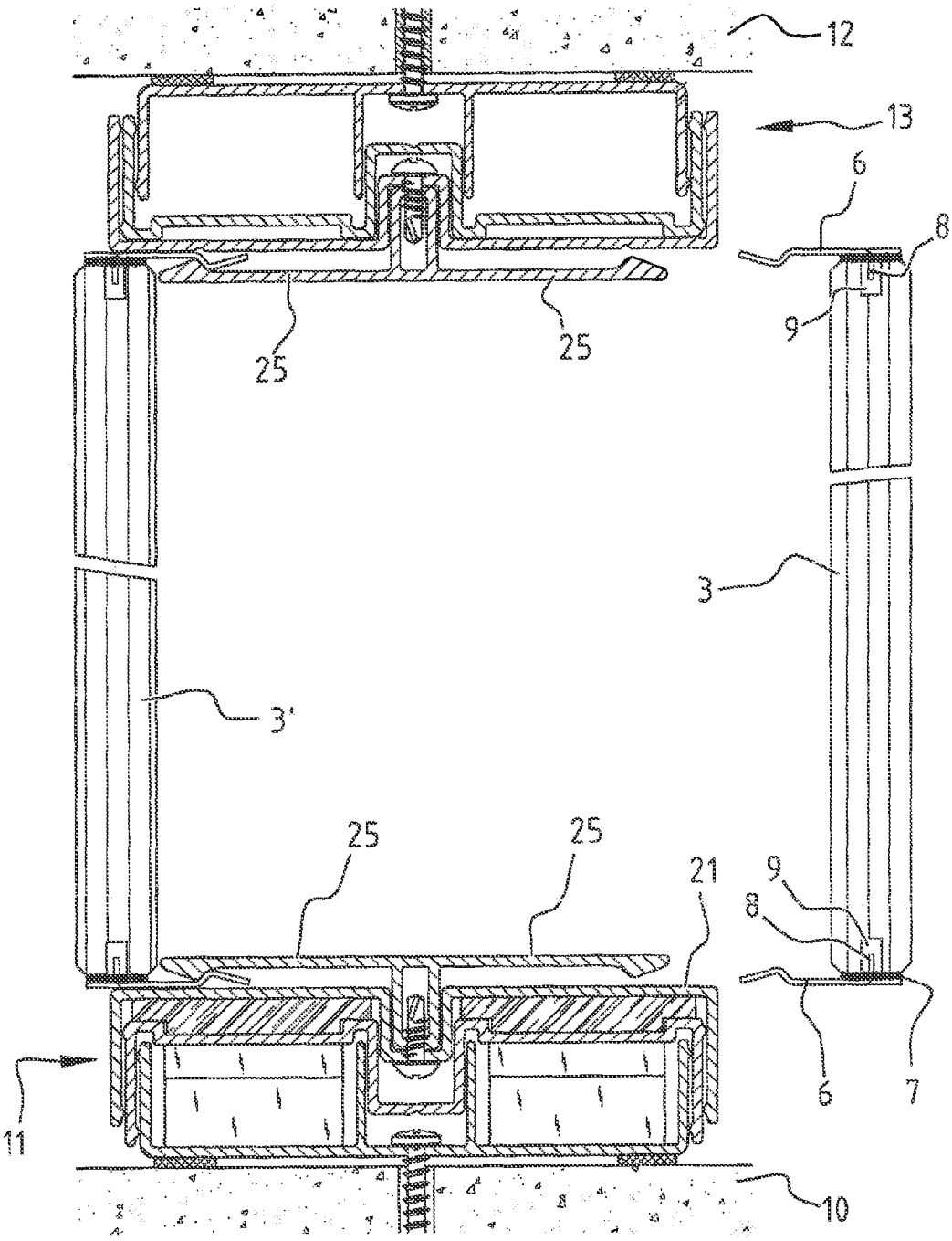
FIGS. 3 and 12 are cross-sectional views along the lines III-III and XII-XII, respectively, of FIG. 1.

In FIG. 1 there is shown a partition wall 1 designed for partitioning off a space in a building that is accessible to persons, which partition wall 1 is (for the sake of simplicity) made up of only one door 2 with glass panels 3, 4 provided on either side thereof. As will be explained yet hereinafter, each glass panel 3, 4 is provided with a lip 6 at its bottom edge 5, which lip extends inward (FIG. 2). The lip 6 extends along the entire width of the glass panel 3, 4 and is fixed to the glass panel 3, 4 via an adhesive strip 7. The lip 6 is furthermore flanged along part of its length, with the flanged part 8 thereof extending into a correspondingly shaped recess 9 in the glass panel 3, 4 (FIG. 2*a*). It is noted that the glass panel 3, 4 is identically configured at its upper side, i.e. also provided with a lip 6 that is locally flanged, as is shown in FIG. 3. FIG. 2*b* shows that the lip 6 is flanged along its entire length, and that the flanged edge 8 abuts against the vertical side surface of the glass panel 3, 4.

Figure 4:
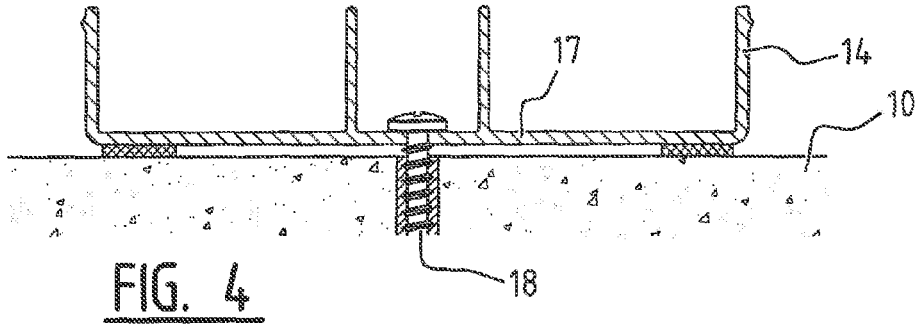
FIGS. 4-11 shows steps of an assembly of components of the partition wall of FIG. 3.
Figure 5:
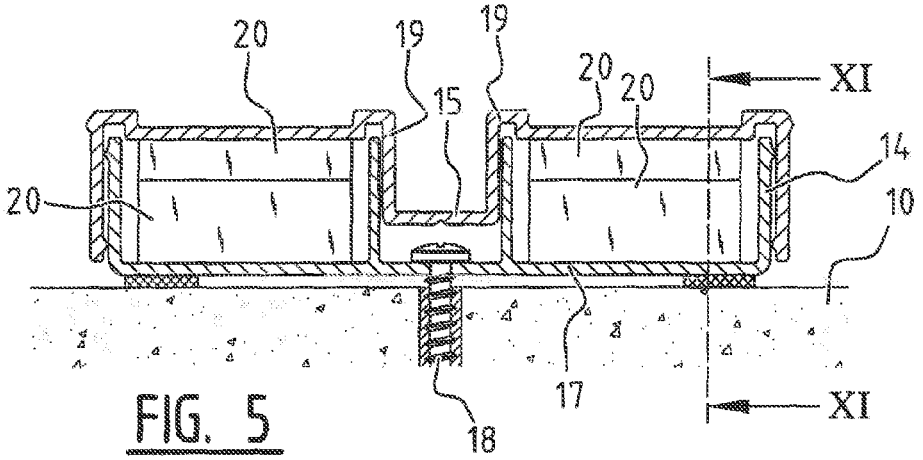
Figure 6:
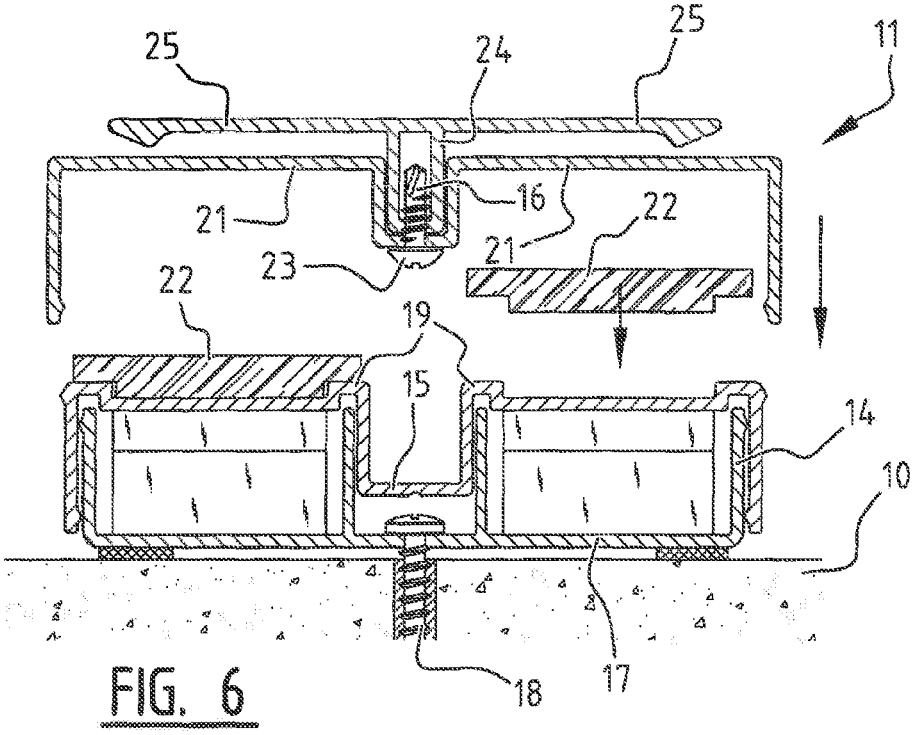

With reference now to FIGS. 4-11, the partition wall 1 further comprises a lower horizontal member 11 to be fixed to a floor 10 (FIGS. 4, 5 and 6), an upper horizontal member 13 to be fixed to a ceiling 12 (FIGS. 7, 8 and 9), between which lower horizontal member 11 and which upper horizontal member 13 the door 2 and the glass panels 3, 4 are mounted. As shown in FIGS. 4, 5 and 6, the lower horizontal member 11 comprises three longitudinally extending elongate profiles 14, 15, 16, each having a U-shaped cross-section. The first profile 14 is fixed to the floor 10 with a base part 17 of its U-shaped cross-section, using screws 18. As a result, lateral movement of the lower horizontal member 11 upon placement of a glass panel 3, 4 can be efficiently prevented. Following that, the second profile 15 is placed over the first profile 14, with base parts 17, 19 of the U-shaped cross-section is of the two profiles 14, 15 facing away from each other (FIG. 5). In order to ensure that the lower horizontal member 11 eventually to be formed is mounted level relative to the floor 10, use is made of intermediate wedge-shaped adjusting blocks 20. Their function will be explained in more detail yet with reference to FIGS. 10 and 11. Finally, the third profile 16 is placed on the second profile 15, with base parts 17, 21 of the U-shaped cross-sections of the first and the third profile 14, 16 facing away from each other (FIG. 6). Use may be made of spacer blocks 22 for positioning the second and the third profile 15, 16 a predetermined distance apart. As shown in FIG. 6, the third profile 16 comprises a springy clamping profile 24 fixed to its base 21 by means of screws 23. The clamping profile 24 has a T-shaped cross-section, whose legs 25 are configured as spring legs.

Figure 7:
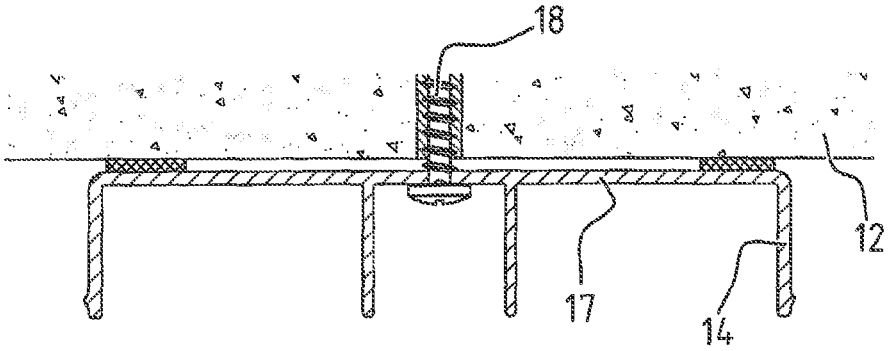
Figure 8:
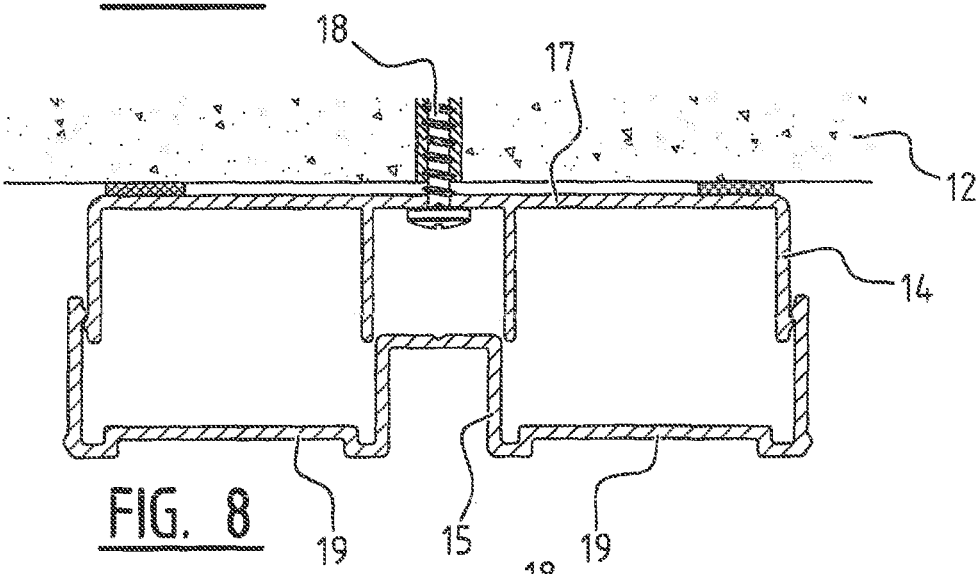
Figure 9:
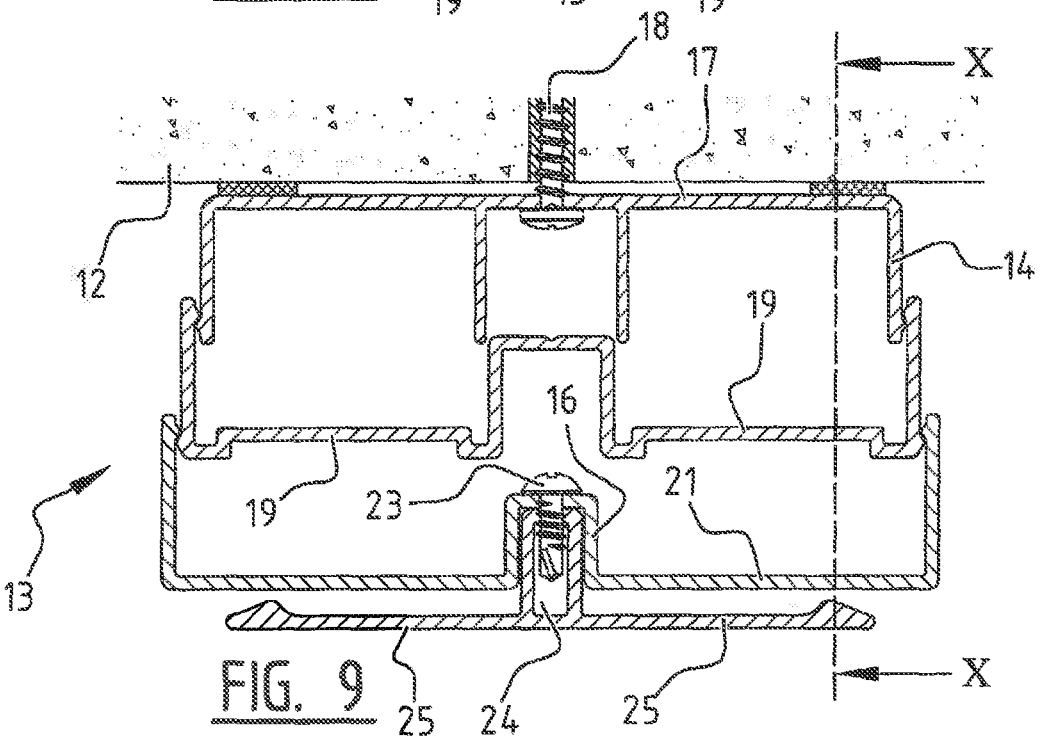

Fixing the upper horizontal member 13 to the ceiling 12 is done in the same way as fixing the lower horizontal member 11 to the floor 10, and identical components are used (with the exception of the wedge-shaped blocks 20 and the spacer blocks 22). Reference is made to FIGS. 7-9, in which corresponding parts are indicated by the same numerals. Mating ribs in the legs of the U-shaped cross-sections of the first, the second and the third profile 14, 15, 16 prevent the second and the third profile 15, 16 from falling down during assembly (FIGS. 7, 8 and 9).

Figure 10A:
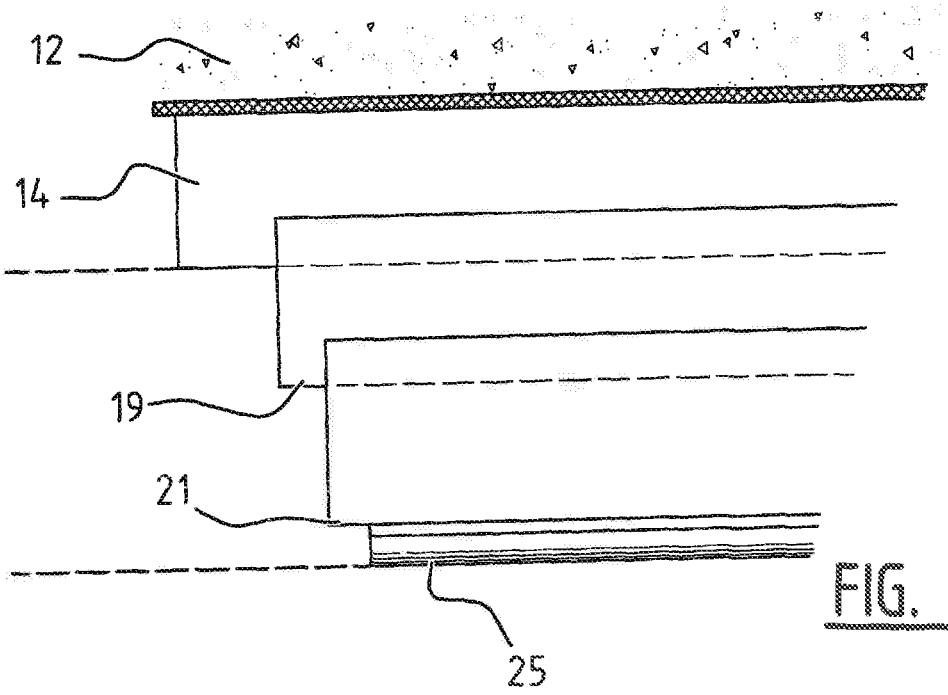
Figure 10B:
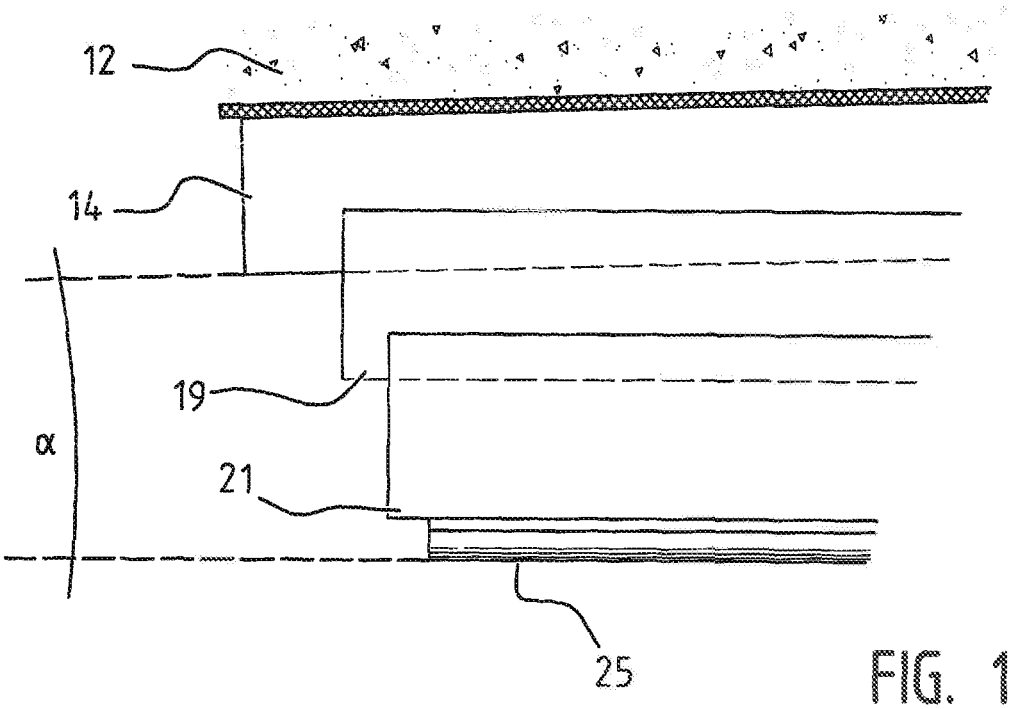

FIGS. 10 and 11 are sectional views along the lines X-X and XI-XI in FIGS. 9 and 5, respectively. Corresponding parts are indicated by the same numerals. In case the first profile 14 is not positioned level relative to the ceiling 12 or the floor 10 with its base part 17, and an angular deviation $\alpha$ or $\beta$ exists, therefore, it is possible to effect a level position of the second profile 15 relative to the ceiling 12 or the floor 10 via its base part 19 by shifting the position of the wedge-shaped adjusting blocks 20 placed one on top of the other relative to each other.

FIG. 3 shows how glass panels 3, 3'; 4, 4' are clamped to the lower horizontal member 11 and the upper horizontal member 13 on either side thereof, with the lips 6 fixed to the bottom edges 5 thereof being clampingly provided between the base parts 21 of the U-shaped cross-sections of the third profiles 16 and the spring legs 25 of the clamping profiles 24.

Figure 12:
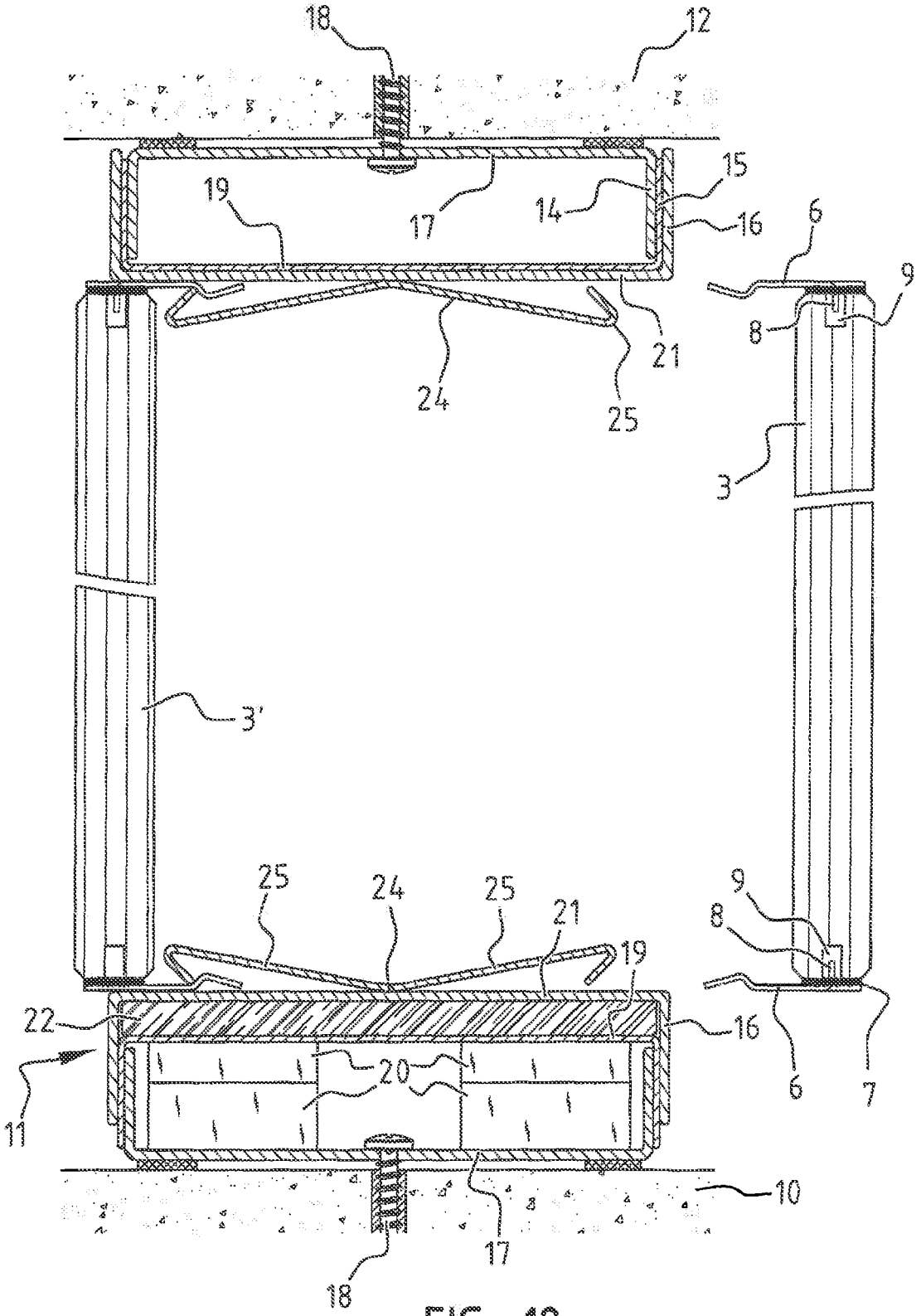
Figure 13:
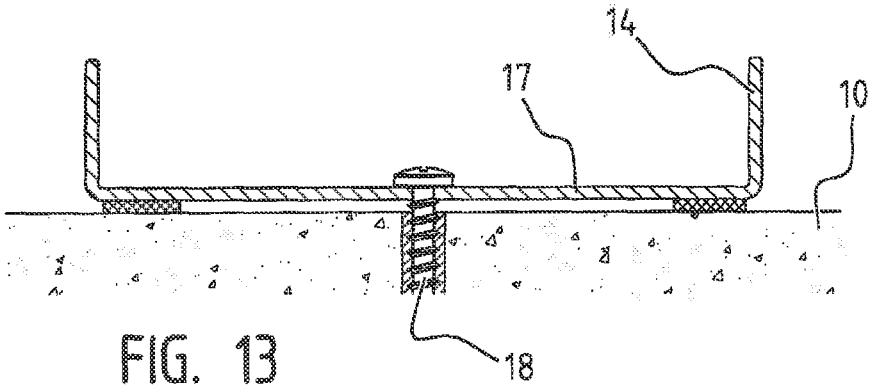
Figure 14:
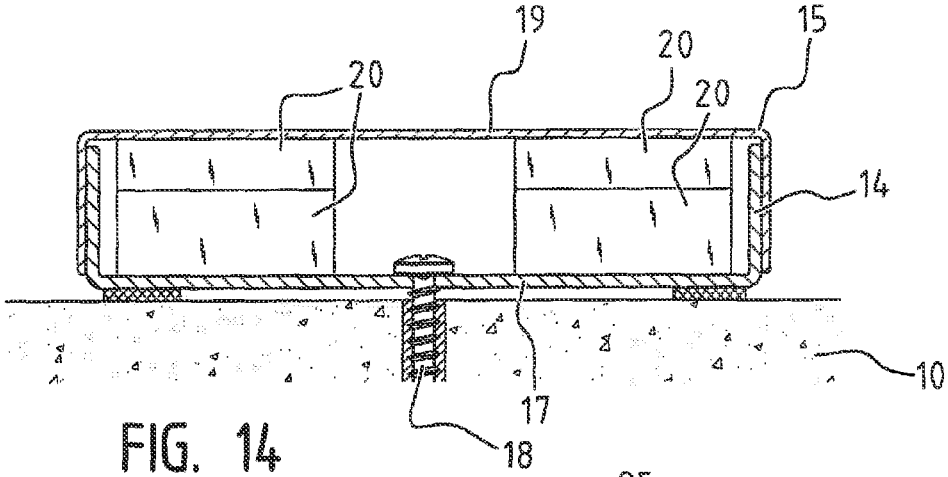
Figure 15:
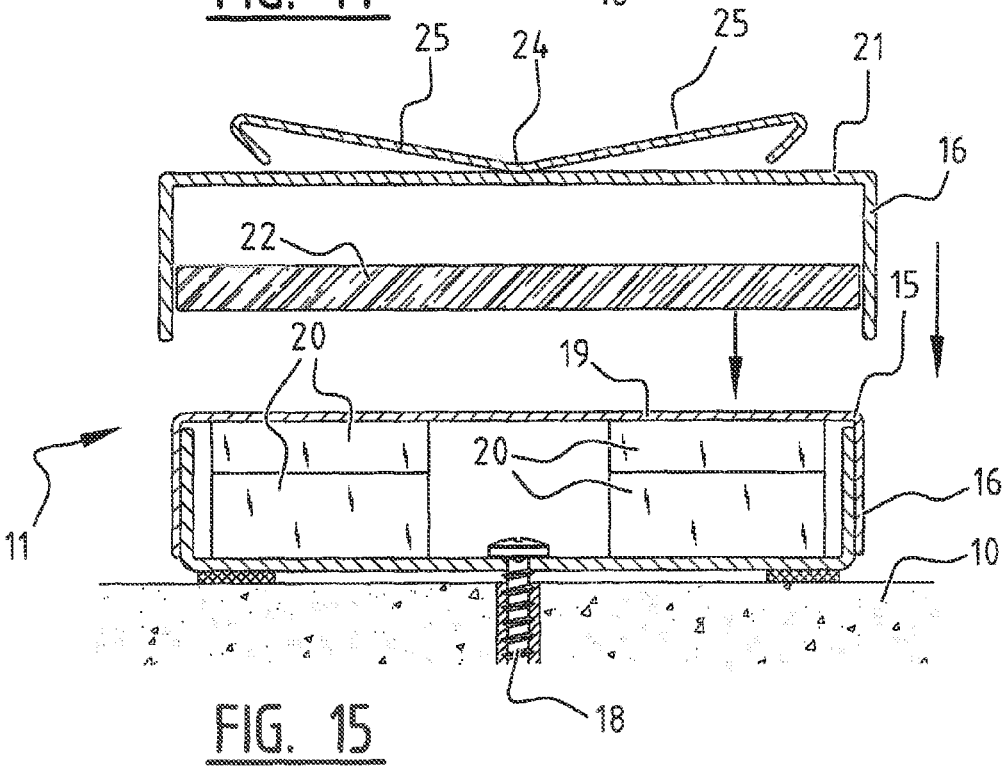
Figure 16:
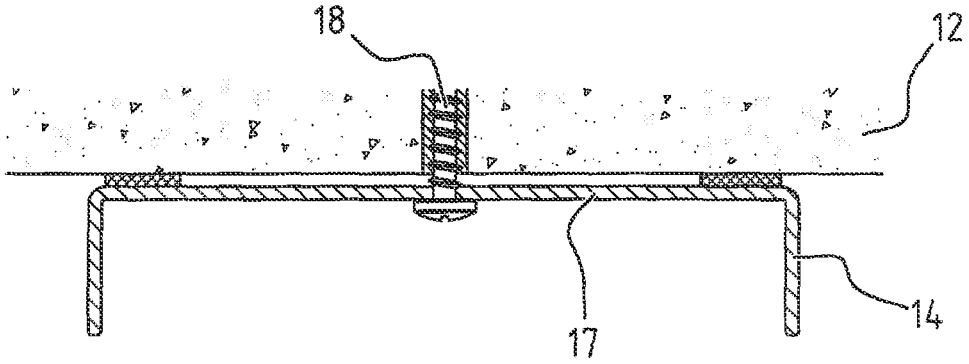
Figure 17:
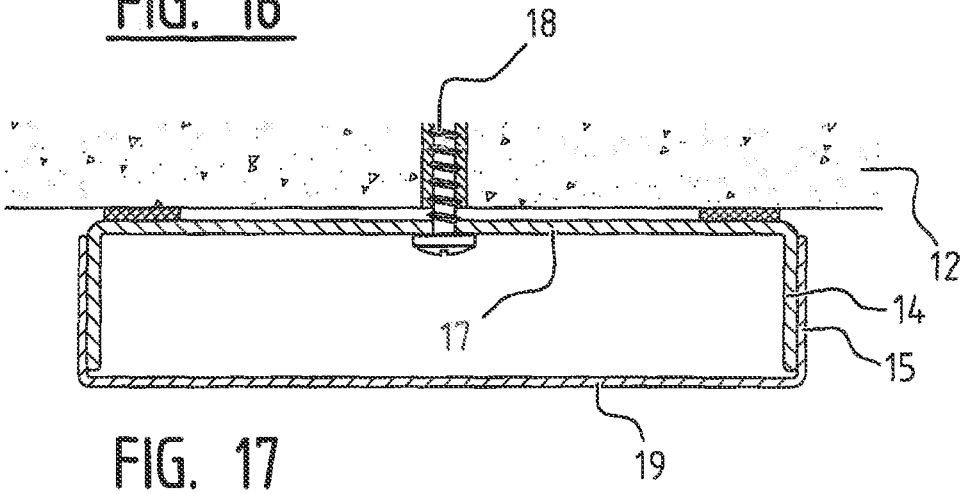
Figure 18:
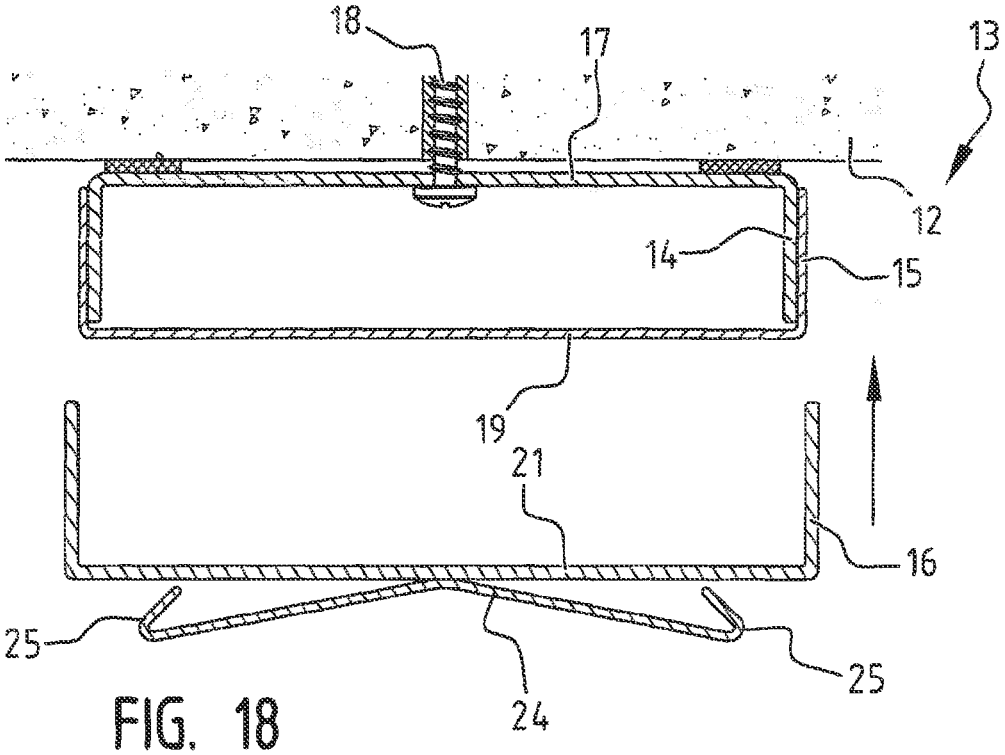

As already noted before, FIGS. 13-18 correspond to FIGS. 4-9, albeit relating to an assembly of the partition wall of FIG. 12 in which components which are in part different are used. Corresponding parts are indicated by the same numerals. As shown, the third profile 16 comprises a springy clamping profile 24 welded to its base part 21. The clamping profile 24 is of W-shaped cross-section, with the legs 25 of the W-shaped being configured as spring legs. It will be readily understood that inserting the lip can take place in a simple manner due to the upwardly sloping insert surface thereof, and that removing the glass panel 3, 4 is made difficult by the inwardly bent legs of the W-shaped clamping profile 24. FIG. 12, which corresponds to FIG. 3, shows the way in which glass panels 3, 3'; 4, 4' are clamped to the lower horizontal member 11 and the upper horizontal member 13 on either side thereof, with the lips 6 fixed to the bottom edges 5 thereof being clampingly provided between the base parts 21 of the U-shaped cross-sections of the third profiles 16 and the spring legs 25 of the clamping profiles 24. FIG. 12 also shows that the glass panel 3' is positioned partially (and possibly also entirely) above the lower horizontal member 11, viewed in downward projection, and is supported on the lower horizontal member 11 with the part of the lip 6 with which the lip 6 is attached to the glass panel 3'. This reduces the load on the connection of the lip 6 to the glass panel 3' (in this case provided by the adhesive strip 7). Such a manner of supporting is also advantageous for other embodiments of a wall according to the invention.

FIG. 19 is a cross-sectional view of two preferred variants, in which corresponding parts are indicated by the same numerals. In the left-hand variant, the profiles 14, 15, 16 can telescope in and out relative to each other so as to compensate for differences in height in the floor. Legs of the third profile 15 embrace legs of the first profile 14, whilst legs of the second profile 16 embrace legs of the third profile 15. In the right-hand variant, the third profile 15 is turned upside-down, and the embrace takes place as described before: legs of the first profile 14 embrace legs of the third profile 15, and legs of the third profile 15 embrace legs of the second profile 16.

The invention is not limited to the illustrated embodiments, but also extends to other preferred variants that fall within the scope of the appended claims. The clamping profile may for example comprise legs which are connected to the base part of the clamping profile via an elastic body (for example of rubber). The clamping force can in that case be provided by the elastic body.

The invention claimed is:

1. A wall comprising:

an upper horizontal member coupled to a ceiling;

a lower horizontal member coupled to a floor; and at least one panel provided between the upper horizontal member and the lower horizontal member, wherein the lower horizontal member and the upper horizontal member each comprise a first and a second longitudinally extending, elongate profile of U-shaped cross-section, wherein the first profile of both the lower horizontal member and the upper horizontal member is fixed to the floor or to the ceiling with a base part of its U-shaped cross-section respectively, wherein the second profile is placed on the first profile, wherein the base parts of the U-shaped cross-sections of the first and second profiles face away from each other, wherein the lower horizontal member and the upper horizontal member each further comprises a third profile of U-shaped cross-section provided between the first profile and the second profile thereof, said first, second, and third profiles of the lower horizontal member being identical to the said first, second, and third profiles of the upper horizontal member, and wherein a spacing between the base parts of the U-shaped cross-sections of the first and the third profile in both the lower horizontal member and the upper horizontal member is adjustable.

2. A wall according to claim 1, wherein base parts of the U-shaped cross sections of the first and the third profile face away from each other.

3. A wall according to claim 2, wherein the U-shaped cross-section of the first profile and the third profile of the lower horizontal member and the upper horizontal member each comprise legs, wherein the legs of the third profile embrace the legs of the U-shaped cross-section of the first profile.

4. A wall according to claim 3, wherein the U-shaped cross-section of the second profile of the lower horizontal member and the upper horizontal member each comprise legs, wherein the legs of the second profile embrace the legs of the U-shaped cross-section of the third profile.

5. A wall according to claim 1, wherein base parts of the U-shaped cross-sections of the first and the third profile face each other.

6. A wall according to claim 5, wherein the U-shaped cross-section of the first profile and the third profile of the lower horizontal member and the upper horizontal member each comprise legs, wherein the legs of the first profile embrace the legs of the U-shaped cross-section of the third profile.

7. A wall according to claim 6, wherein the U-shaped cross-section of the second profile of the lower horizontal member and the upper horizontal member each comprise legs, wherein the legs of the third profile embrace the legs of the U-shaped cross-section of the second profile.

8. A wall according to claim 1, wherein the spacing between the base parts of the U-shaped cross-sections of the second and the third profile is adjustable.

9. A wall according to claim 1, wherein the base part of the U-shaped cross-section of the second profile comprises a springy clamping profile mounted thereon, and wherein the panel comprises a lip fixed to its bottom edge, which lip extends inward and which is clampingly provided between the base part of the U-shaped cross-section of the second profile and the springy clamping profile to connect the panel to the lower horizontal member and the upper horizontal member.

10. A wall according to claim 9, wherein the lip fixed to the bottom edge of the panel and a lip fixed to an upper edge of the panel extend along an entire width of the panel.

11. A wall according to claim 9, wherein the lip fixed to the bottom edge of the panel and a lip fixed to an upper edge of the panel are each provided with a profiled, longitudinal insert edge.

12. A wall according to claim 11, wherein the profiled, longitudinal insert edges provided on the lip fixed to the bottom edge of the panel and the lip fixed to the upper edge of the panel each comprise an upwardly sloping insert surface.

13. A wall according to claim 11, wherein the lip fixed to the bottom edge of the panel and the lip fixed to the upper edge of the panel are glued to the panel at their longitudinal edges remote from their respective profiled, longitudinal insert edges.

14. A wall according to claim 11, wherein longitudinal edges remote from the insert edges of the lip fixed to the bottom edge of the panel and of the lip fixed to the upper edge of the panel are flanged along at least part of their length, and wherein flanged parts thereof extend into recesses in the panel.

15. A wall according to claim 9, wherein the springy clamping profiles mounted to the second profiles of the lower horizontal member and the upper horizontal member each have a W-shaped cross-section.

16. A wall according to claim 15, wherein the W-shaped cross-section of the springy clamping profiles each comprise legs, wherein the legs of the W-shaped cross-section are spring legs, and wherein longitudinal edges of the spring legs are bent inwards.

17. A wall according to claim 9, wherein the springy clamping profiles mounted to the second profiles of the lower horizontal member and the upper horizontal member extend along an entire length of said second profiles.

18. A wall according to claim 1, wherein the wall is provided with a door comprising a lower horizontal member and an upper horizontal member thereof, wherein the a lower horizontal member and the upper horizontal member of the door each comprise a first and second longitudinally extending, elongate profile of U-shaped cross-section, wherein the first profile is fixed to the floor with a base part of its U-shaped cross-section, wherein the second profile is placed on the first profile, wherein base parts of the U-shaped cross-sections of the first and second profiles face away from each other, wherein the lower horizontal member of the door further comprises a third profile of U-shaped cross-section provided between the first profile and the second profile thereof, and wherein base parts of the U-shaped cross-sections of the first and the third profile face away from each other.

19. A wall according to claim 18, wherein the lower horizontal member and the upper horizontal member of the door have the same height as the corresponding horizontal members of the rest of the wall.

20. A wall according to claim 1, wherein the base part of the first and second profiles of U-shaped cross-section of the upper horizontal member or the lower horizontal member comprises, on a first side thereof, profile wall sections that extend transversely to the base part, and which is provided, on a second side thereof, with a W-shaped or T-shaped clamping profile, which is connected to the base part with a central part thereof and which defines two legs extending from the central part, wherein the legs are configured as spring legs, with two slots being defined between the legs and the second side of the base part, and wherein the legs are provided with locking projections on the side of the legs that faces the second side of the base part.

* * * * *